US006435260B1

(12) United States Patent
Fink et al.

(10) Patent No.: US 6,435,260 B1
(45) Date of Patent: Aug. 20, 2002

(54) HOT-CHAMBER DIECASTING MACHINE

(75) Inventors: Roland Fink, Winterbach; Ulrich Schraegle, Remshalden, both of (DE)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 09/422,335

(22) Filed: Oct. 21, 1999

(30) Foreign Application Priority Data

Nov. 18, 1998 (DE) ..... 198 53 189

(51) Int. Cl.[7] ..... B22D 17/02; B22D 27/02

(52) U.S. Cl. ..... 164/316; 164/507; 164/513

(58) Field of Search ..... 164/284, 303, 164/312, 316, 507, 513, 471, 493; 219/642, 643, 608

(56) References Cited

U.S. PATENT DOCUMENTS 3,755,884 A * 9/1973 Dupy ..... 29/481
3,777,097 A * 12/1973 Budzinski ..... 219/10.59
4,834,168 A * 5/1989 Nove et al. ..... 164/504
5,579,825 A * 12/1996 Shibata et al. ..... 164/493
5,872,352 A * 2/1999 Suganuma et al. ..... 219/646
5,960,854 A * 10/1999 Fink et al. ..... 164/316

FOREIGN PATENT DOCUMENTS

| | | |
|---|---|---|
| DE | 19631161 A1 | 2/1997 |
| DE | 19543805 A1 | 4/1997 |
| EP | 0761345 A2 | 3/1997 |

* cited by examiner

*Primary Examiner*—M. Alexandra Elve
*Assistant Examiner*—Len Tran
(74) *Attorney, Agent, or Firm*—Crowell & Moring LLP

(57) ABSTRACT

Hot-chamber diecasting machines for processing magnesium melts include a casting vessel, an inductive heating system, and an additional ring inductor in an area of the neck of the casting vessel in order to achieve a heating also in this area. The ring inductor is formed of a one-piece tube made of an elastic material which is open at one point and can be bent open by the extent of the diameter of the neck of the casting vessel and can be pushed laterally onto the casting vessel, and through which air can also flow for the cooling.

14 Claims, 2 Drawing Sheets

HOT-CHAMBER DIECASTING MACHINE

BACKGROUND AND SUMMARY OF THE INVENTION

This application claims the priority of German application 198 53 189.3, filed in Germany on Nov. 18, 1998, the disclosure of which is expressly incorporated by reference herein.

The invention relates to a hot-chamber diecasting machine for processing magnesium melts, comprising a casting vessel with an ascending bore, a conical mouthpiece, a nozzle attached to the mouthpiece, and an inductively operating heating device which is operated at a medium frequency or at a frequency at the lower limit at the high frequency, a ring inductor being placed in the plane of the covering of the crucible for the melt around the casting vessel.

A hot-chamber diecasting machine of this type is known from German Patent Document DE 195 43 805A1 (incorporated in part in U.S. Pat. No. 5,960,854). In order to achieve a heating in the area of the neck of the casting vessel, a ring inductor is provided there which is constructed of two halves but which then, because the neck of the casting vessel is very difficult to access, at least in the installed condition of the casting vessel, must be mounted and possibly demounted at high expenditures. As a rule, it becomes necessary in this case to also detach the casting vessel in order to have better access to its neck.

From German Patent Document DE 195 31 161A1 (incorporate in part U.S. Pat. No. 5,960,854), it is known to assign inductors to the mouthpiece area of the casting vessel and to the nozzle, which inductors are constructed as tubes insulated on the outside and are pushed as sleeve-shaped spirals in each case axially onto the mouthpiece area and the nozzle. These tubes are acted upon by a medium frequency or by a frequency at the lower limit of the high frequency, and air flows through these tubes in order to avoid an overheating. When used for hot-chamber diecasting machines by means of which magnesium melts are to be processed, such a further development has the advantage that there can be no contact of water, which is normally used for the cooling, with magnesium.

It is an object of the present invention to find a solution for easily mounting the ring inductor in the area of the neck of the casting vessel, which neck area can also be further developed such that the ring inductor can also be cooled with air.

For achieving this object, it is provided in the case of a hot-chamber diecasting machine of the initially mentioned type that the ring inductor includes at least one bendable tube made of an elastic material which forms a one-piece ring which is open at one point and is provided there with connections for energy and for cooling air flowing through.

If the elasticity of the tube ring is so large that the tube ring can be bent open at its open point by the extent of the diameter of the casting vessel in the area of the crucible covering and can be slid laterally onto the neck of the casting vessel, this further development has the considerable advantage that a relatively easy mounting can be carried out without the necessity of detaching the casting vessel from its fastening on the crucible.

As a further development of preferred embodiments of the invention, the tube may be a flat tube which is bent about an axis extending in parallel to its larger lateral surfaces. In this case, in a further development of the invention, one of the larger lateral surfaces of the flat tube can be connected with a carrier band, in which case the carrier band and the flat tube may be surrounded by an insulating woven fabric for the thermal and electric insulation.

As a further development of the invention, the insulating woven fabric can consist of a band which is wound around the flat tube and the carrier band.

Other objects, advantages and novel features of the present invention will become apparent from the following detailed description of the invention when considered in conjunction with the accompanying drawings.

DETAILED DESCRIPTION OF THE INVENTION

Figure 1:
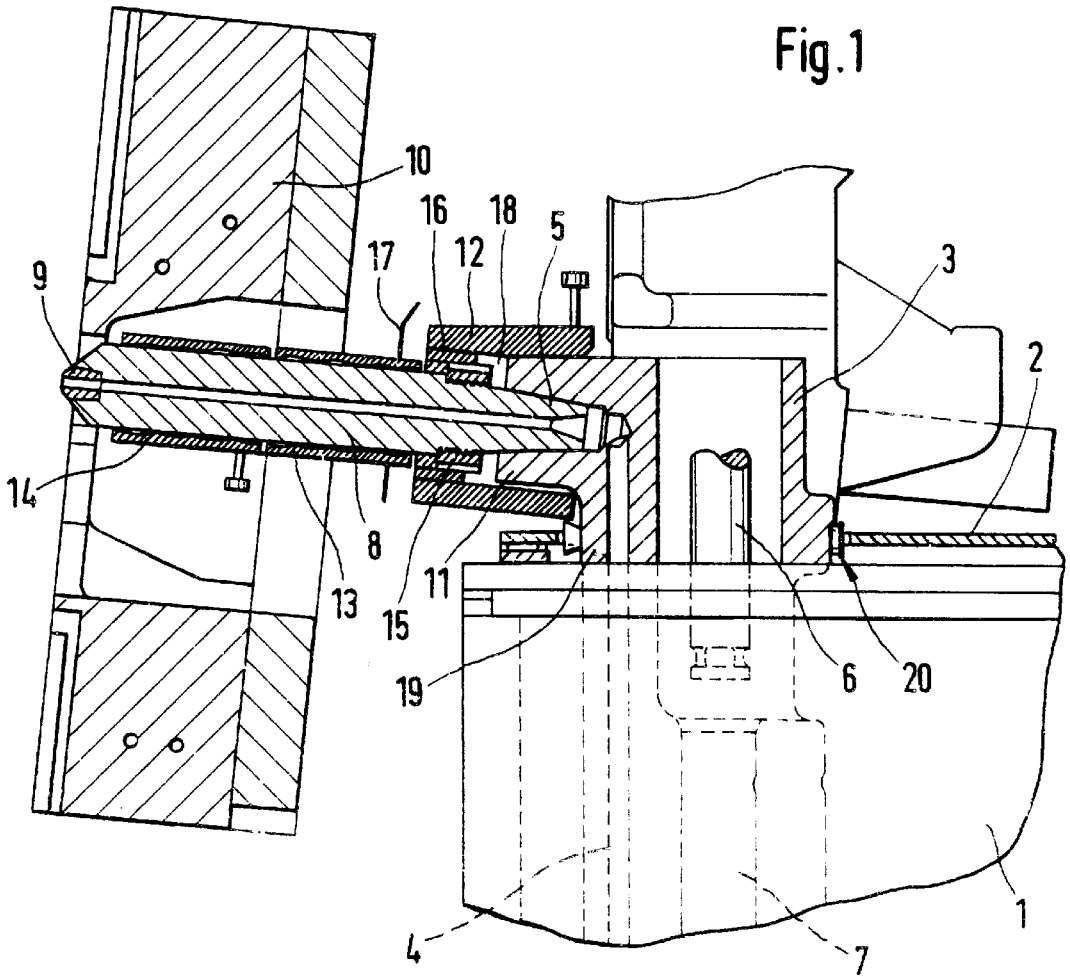
FIG. 1 is schematic sectional view of the outlet area of a hot-chamber diecasting machine constructed according to a preferred embodiment of the invention.

FIG. 1 shows a portion of a hot-chamber diecasting machine which is used for processing magnesium. In this case, the liquid magnesium is situated at temperatures of approximately 630° C. to 680° C. within the crucible not shown here in detail. Through a covering 2, a casting vessel 3 projects into this crucible 1, which casting vessel 3 has an ascending bore 4 with a conically shaped mouthpiece 5. In addition, a casting piston, which is also not shown here in detail and which is guided by way of the piston rod 6 in a known manner from above into the casting cylinder 7, is also situated in the casting vessel 3, which casting cylinder 7 is filled from the crucible 1 with the amount of liquid magnesium to be cast, before the piston closes off the filling opening during its movement and presses the liquid metal upwards through the ascending bore 4.

A nozzle 8 is inserted into the mouthpiece 5 of the casting vessel 3, which nozzle 8 reaches with its mouthpiece 9 into the gating area of a mold 10 which is only schematically outlined.

A sleeve-shaped inductive heating body 12 is pushed onto the approximately cylindrical projection 11 of the casting vessel 3. Two additional sleeve-shaped inductive heating bodies 13 and 14 are pushed onto the central area of the nozzle 8 or onto the area of the mouthpiece 9 of the nozzle 8. This can take place in that the sleeve body 12 is pushed on before the mounting of the nozzle 8, that then the nozzle is inserted into its conical connection opening 5, and in that the two sleeve bodies 13 and 14 are then pushed onto the nozzle. As a rule, a separate fastening is not necessary because, as the result of the slight inclination of the nozzle 8, the sleeve bodies hold on their own, and the sleeve body holds on the also slight inclination also without separate fastening devices. Since there is no fastening, all heating bodies 12, 13 and 14 can be easily displaced by hand in order to reach the optimal temperature in the corresponding areas.

The sleeve body 12 is placed on the projection 11 such that it protrudes over its end toward the outside. In this case, the sleeve body 12 also protrudes over a nut 15, which is screwed onto the nozzle 8 for its later demounting, as well as over a monitoring device which is arranged on the interior side of the sleeve body 12 in the form of a ring equipped with a contact loop. In the direction of the mouthpiece 9 of the nozzle 8, a guard plate 17, which is to prevent the undesirable penetration of magnesium melt possibly spraying toward the rear, is situated in front of the front end of the sleeve body 12.

The monitoring device 16 has the purpose of detecting magnesium bleeding in the hollow space 18 between the sleeve body 12 and the nozzle 8 which may occur, for example, by a leakage between the projection 11 and the nozzle 8 or by leakiness in the area of the neck 19 of the casting vessel 3 and by the magnesium which therefore enters the area inside the sleeve body 12.

A ring inductor 20 is placed in the area of the neck 19 of the casting vessel 3, specifically also approximately in the area of the crucible covering 2 which, in a manner not shown in detail, is also sealed off with respect to the casting vessel 3.

Figure 2:
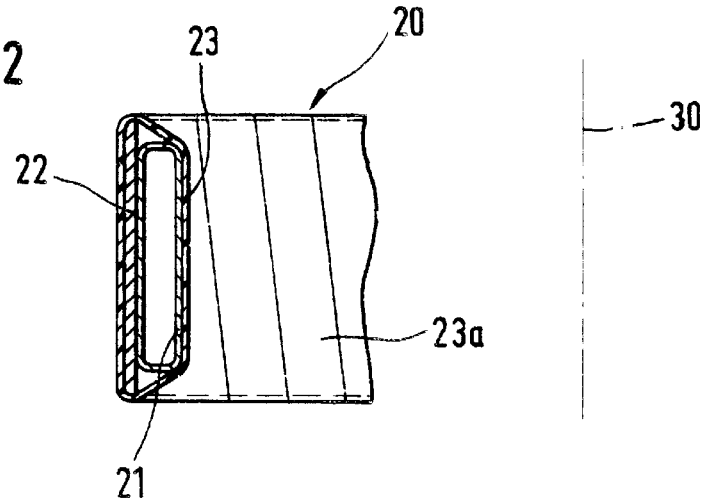
FIG. 2 is an enlarged representation of a partial sectional view of the ring inductor arranged in the area of the casting vessel neck of FIG. 1.

FIG. 2 shows that the ring inductor 20 is equipped with a flat tube 21 which is soldered with one of its larger lateral surfaces to a metallic carrier band 22. The flat tube 21 as well as the carrier band 22 consist of a magnetically effective material, such as a copper alloy or special steel. The carrier band 22 and the flat tube 21 are surrounded by a thermally and electrically effective insulation 23 which, in the embodiment shown, consists of a band-shaped woven insulating fabric 23*a* which is spirally wound around the flat tube 21 and the carrier band 22. The flat tube 21 and the carrier band 22 are bent about an axis 30 extending in parallel to the larger sides of the flat tube 21, which axis 30, in the installed condition—see FIG. 3 and 4—, coincides with the center axis of the neck 19 of the casting vessel 3.

Figure 3:
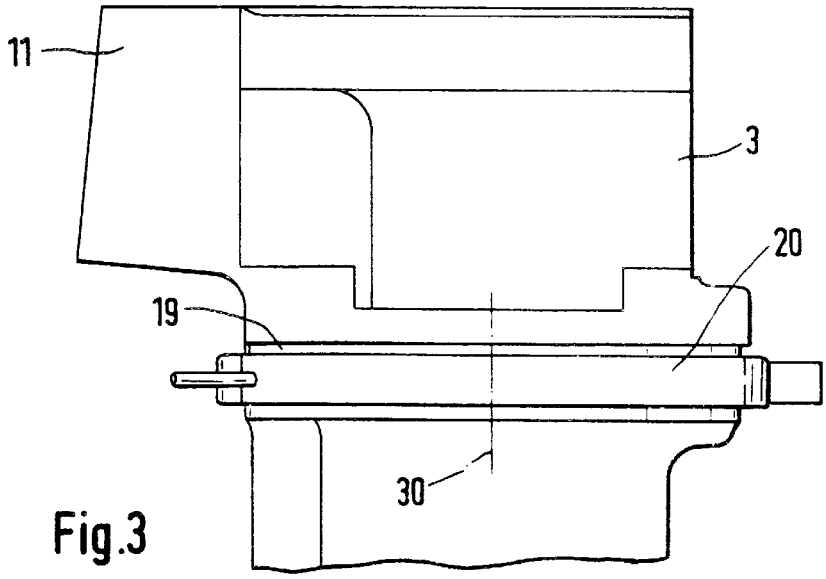
FIG. 3 is a lateral schematic view of the upper end area of the casting vessel with the ring inductor of FIG. 1.

FIG. 3 illustrates that the ring inductor 20 is placed around a section of the neck 19 of the casting vessel 3, specifically such that, by means of one of the larger lateral surfaces of the flat tube 21, specifically the one not connected with the carrier band 22, it rests on the outer surface of the neck 19 of the casting vessel 3.

Figure 4:
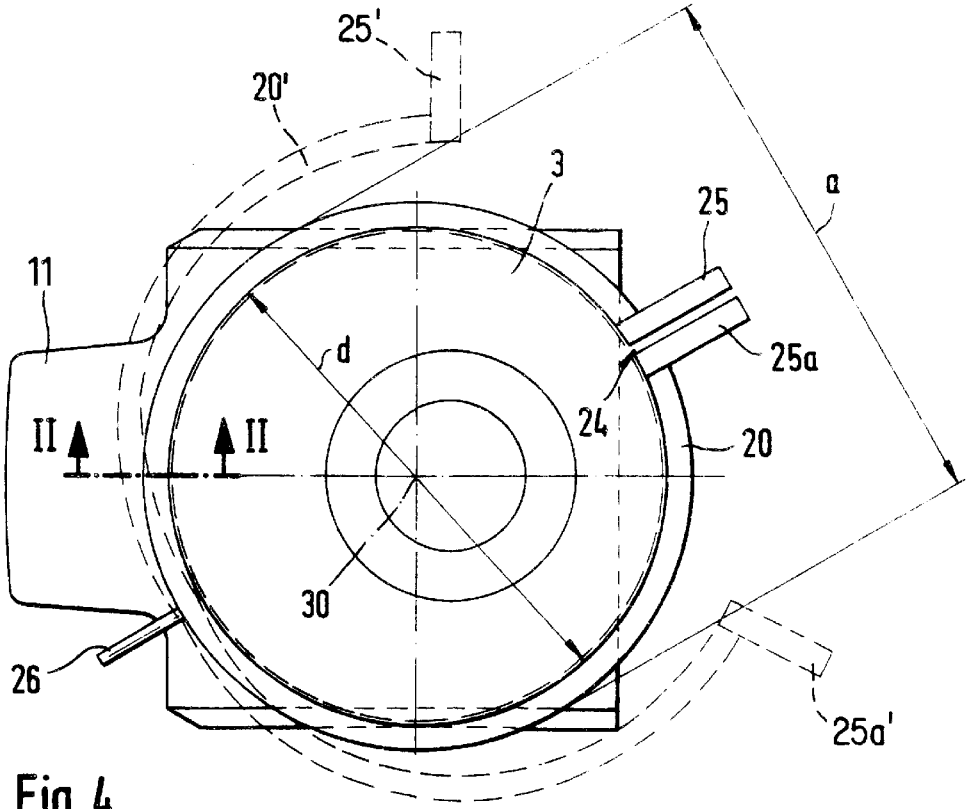
FIG. 4 is a view of the casting vessel of FIG. 3 from below with the ring inductor in the mounted condition and—shown by a broken line—in the bent-open condition for the purpose of the mounting.

FIG. 4 also illustrates that the ring inductor 20 is constructed as a one-piece ring of the flat tube 21 and the carrier tube 22, which ring is, however, open at point 24 and is in each case provided there with connections 25 and 25*a* for the feeding and removal of electric energy—in the embodiment shown, an induction voltage with medium frequency or with a frequency at the lower limit of the high frequency. However, in a manner not shown in detail, the connections 25 and 25*a* also each have a connection piece for the feeding of cooling air which can flow through the flat tube 21 for the purpose of cooling and can leave the flat tube again through a waste air connection piece 26 at a point situated approximately diametrically opposite the connections 25 and 25*a*. Therefore, starting from the connection pieces 25 and 25*a*, the cooling air is in each case guided around approximately half the ring inductor 20 and then exits again through the connection piece 26.

As indicated above, the flat tube 21 and the carrier band 22 are formed of an elastic material which allows a bending-open of the ring inductor 20 into its position 20' which is indicated by a broken line in FIG. 4. The elasticity of the flat tube 21 and of the carrier band 22 must therefore be large enough for allowing such a bending-open. It was found that no difficulties exist in this respect. When the ring inductor 20 is bent open into its position 20' according to FIG. 4, it can very easily be pushed laterally onto the neck 19 of the casting vessel or also be removed again from it. Thus, as the result of its elasticity, it takes up the drawn-out position according to FIG. 4 if the expanding forces are eliminated.

The final fastening can then be carried out very easily, for example, by means of a fixing screw. The ring inductor designed in this manner can be supplied with the same energy as the inductors 12, 13 and 14 and can be connected to the same cooling air source. It has the important advantage of a very simple mounting and demounting which can therefore be carried out without difficulty also in the installed condition of the casting vessel.

FIG. 4 also shows that, in the bent-open condition, that is, in their position 25' and 25*a*', the connections 25 and 25*a*, have a distance a with respect to one another which corresponds to the diameter d of the neck 19 of the casting vessel 3 in order to be able to carry out the mounting or demounting.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Hot-chamber diecasting machine for processing magnesium melts, comprising:

a casting vessel with an ascending bore, a conical mouthpiece which in use opens to the ascending bore, a nozzle attached to the mouthpiece, an inductively operating heating device which is operated at a medium frequency or at a frequency at a lower limit of a high frequency, and a ring inductor placed in a plane of a covering of a crucible for the melt around the casting vessel, wherein the ring inductor comprises at least one bendable tube made of an elastic material, which forms a one-piece ring which is open at a point and is provided there with connections for energy and for cooling air flowing through, and wherein the elasticity of the tube ring is so large that, at the open point, the tube ring can be bent open at least by an extent of the diameter of the casting vessel in an area of the crucible covering and can be laterally pushed onto the neck of the casting vessel.

2. Hot-chamber diecasting machine according to claim 1, wherein the tube is a flat tube with larger lateral surfaces adjoining narrower surfaces, said tube being bent about an axis extending in parallel to the larger lateral surfaces.

3. Hot-chamber diecasting machine according to claim 2, wherein one of the larger lateral surfaces of the flat tube is connected with a carrier band.

4. Hot-chamber diecasting machine according to claim 3, wherein the carrier band (22) and the flat tube (21) are surrounded by an insulating woven fabric (23) for thermal and electric insulation.

5. Hot-chamber diecasting machine according to claim 4, wherein the insulating woven fabric forms a band which is spirally wound around the flat tube and the carrier band.

6. A ring inductor heating assembly for heating a magnesium melt casting vessel at a neck of the vessel disposed below a vessel melt outflow opening, said ring inductor assembly comprising:

an elastic bendable tube which in use forms a one-piece tube ring around the neck of the casting vessel, said bendable tube being provided with connections for energy and cooling air to flow therethrough at ends which form an open point and which face one another when the bendable tube is in an installed in use position on the neck of the casting vessel, wherein said tube is sufficiently elastic to permit bending open of the tube by an amount permitting lateral installation of the tube around the casting vessel neck.

7. A ring inductor heating assembly according to claim 6, wherein the tube is a flat tube with larger lateral surfaces adjoining narrower surfaces, said tube being bent about an axis extending in parallel to the larger lateral surfaces.

8. A ring inductor heating assembly according to claim 7, wherein one of the larger lateral surfaces of the flat tube is connected with a carrier band.

9. A ring inductor heating assembly according to claim 8, wherein the carrier band (22) and the flat tube (21) are surrounded by an insulating woven fabric (23) for thermal and electric insulation.

10. A ring inductor heating assembly according to claim 9, wherein the insulating woven fabric forms a band which is spirally wound around the flat tube and the carrier band.

11. A ring inductor heating assembly for heating a melt casting vessel at a neck of the vessel disposed below a vessel melt outflow opening, said ring inductor assembly comprising:

an elastic bendable tube which in use extends around and contacts a surface of the neck of the casting vessel, wherein said tube is sufficiently elastic to permit bending open of the tube by an amount permitting lateral installation of the tube around the casting vessel neck.

12. A ring inductor heating assembly according to claim 11, comprising a carrier band connected to the tube, said carrier band and tube being made of magnetically effective material, wherein said carrier band and tube are both sufficiently elastic to permit said bending open of the tube by an amount permitting lateral installation of the tube around the casting vessel neck.

13. A ring inductor heating assembly according to claim 12, wherein the carrier band and the flat tube are surrounded by an insulating woven fabric for thermal and electric insulation.

14. A ring inductor heating assembly according to claim 13, wherein the insulating woven fabric forms a band which is spirally wound around the flat tube and the carrier band.

* * * * *